United States Patent [19]

Horiuchi et al.

[11] 4,386,555

[45] Jun. 7, 1983

[54] HYDRAULIC CYLINDER CUSHION DEVICE

[75] Inventors: George H. Horiuchi, Kingsburg, Calif.; Edward J. Wynn, Leola, Pa.

[73] Assignee: Sperry Corporation, New Holland, Pa.

[21] Appl. No.: 206,402

[22] Filed: Nov. 13, 1981

Related U.S. Application Data

[63] Continuation of Ser. No. 10,570, Feb. 9, 1979, abandoned.

[51] Int. Cl.[3] ..... F15B 15/22

[52] U.S. Cl. ..... 91/395; 91/20; 91/396

[58] Field of Search ..... 91/395, 394, 396, 25, 91/26, 20; 92/85 B

[56] References Cited

U.S. PATENT DOCUMENTS

| | | | |
|---|---|---|---|
| 2,755,775 | 7/1956 | Flick et al. | 91/395 |
| 2,884,903 | 5/1959 | Pauly | 91/395 |
| 3,260,167 | 7/1966 | Pedersen et al. | 91/395 |
| 3,704,650 | 12/1972 | Berg | 91/395 |
| 3,974,910 | 8/1976 | Papai | 91/396 |

*Primary Examiner*—Paul E. Maslousky

*Attorney, Agent, or Firm*—Larry W. Miller; Frank A. Seemar; Darrell F. Marquette

[57] ABSTRACT

The disclosure is directed to a hydraulic cylinder with an improved cushion device thereon to enhance the operational characteristics thereof. A cushion pin is affixed to the cylinder piston by a cap screw in such a manner that the cushion pin can float about the screw relative to the piston. Optional orifices in the cushion pin provide an additional fluid flow passage whereby the metering action between the pin and a fluid flow port to the cylinder is different for retraction and extension of the piston.

3 Claims, 3 Drawing Figures

HYDRAULIC CYLINDER CUSHION DEVICE

This is a continuation of application Ser. No. 010,570, filed Feb. 9, 1979, now abandoned.

BACKGROUND OF THE INVENTION

This invention is directed generally to hydraulic cylinders, and specifically to a hydraulic cylinder with an improved cushion device thereon.

Modern industry has found many important functions for hydraulic cylinders which were heretofore met by more complex and costly mechanical mechanisms. The invention herein described and claimed relates primarily to hydraulic cylinders which must change speed at the end of a stroke to absorb the shock produced by a high mass workload and/or high piston speed.

The concept of a cushion pin is not per se new. An example can be found in the bale wagon art, where, some time ago it was observed that the cylinder which rapidly raises and lowers the heavy second table (see U.S. Pat. No. 4,088,231) encountered severe undesirable shock loads, particularly at the end of the retraction phase of the cycle. The solution to this problem was envisioned to be the employment of a rigid pin on the face of the cylinder piston which moved into and out of a fluid flow port to restrict the flow of hydraulic fluid therethrough, and, thus, break or "cushion" the motion of the piston. The cushion pin used was rigidly affixed to the piston face and had to be carefully sized and oriented relative to the fluid flow port. While the fixed pin concept improved the cylinder operation, it was impossible to build such a mechanism with very small clearances between the pin and the walls of the fluid flow port. As one of skill in the art will readily appreciate, inherent machining tolerances permit a minimum clearance between concentric circular components of about 1/32 of an inch. Since much smaller clearances are often desirable, the prior art permitted only a limited selection of cylinder operating characteristics.

SUMMARY OF THE INVENTION

It is, therefore, an object of the instant invention to provide a cushion device for a hydraulic cylinder which overcomes the problems inherent in the prior art.

It is a feature of the instant invention to provide an improved cushion device for a hydraulic cylinder.

It is another feature of the instant invention to provide an improved cushion pin for a hydraulic cylinder.

It is another feature of the instant invention to provide a cushion pin for a hydraulic cylinder which is mounted to the cylinder piston for flotation relative thereto.

It is a further feature of the instant invention to provide a cushion pin for a hydraulic cylinder which automatically adjusts to a position of concentricity within the fluid flow port.

It is a still further feature of the instant invention to provide a cushion pin for a hydraulic cylinder which provides differing metering rates for retraction and extension of the cylinder piston.

These and other features and objects are accomplished according to the instant invention by providing an improved cushion device for enhancing the operational characteristics of a hydraulic cylinder. A cushion pin is affixed to the piston of the cylinder by a cap screw in such a manner that the cushion pin can float about the screw relative to the piston. Optional orifices in the cushion pin provide an additional fluid flow passage whereby the metering action between the pin and a fluid flow port to the cylinder is different for retraction and extension of the piston.

BRIEF DESCRIPTION OF THE DRAWINGS

The advantages of this invention will become apparent upon consideration of the following detailed disclosure of the invention, especially when taken in conjunction with the accompanying drawings wherein.

DESCRIPTION OF THE PREFERRED EMBODIMENT

Figure 1:
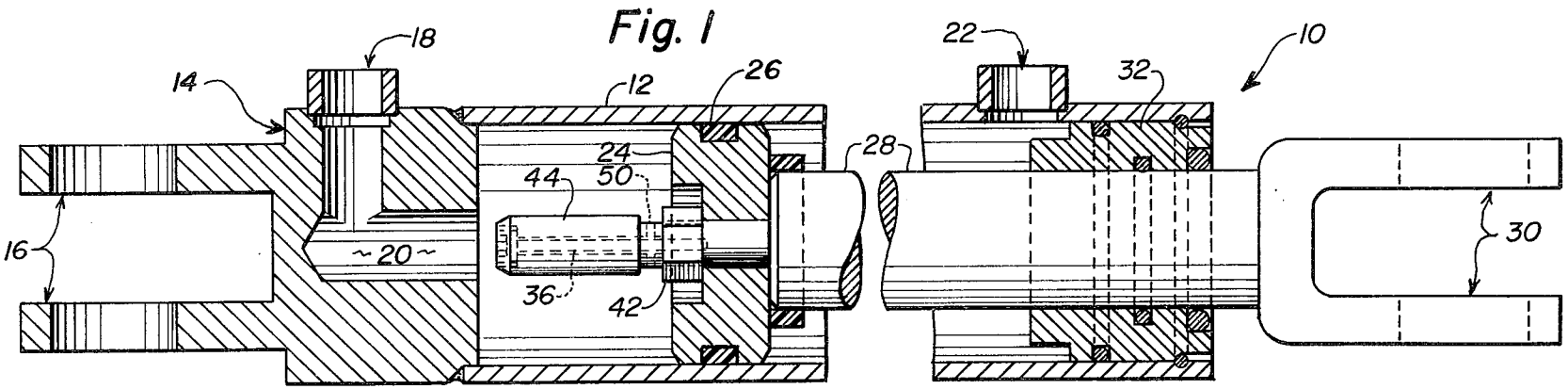
FIG. 1 is a schematic partial cross sectional view of a hydraulic cylinder showing the various components thereof and the preferred embodiment of the invention.

Attention is now directed to FIG. 1 wherein a hydraulic cylinder with which the instant invention may be employed is generally designated by the reference numeral 10. A main body portion 12 is comprised of a rigid hollow cylindrical member having length and diameter dimensions which may vary according to the specific intended use. A first end of body 12 is generally closed by an end cap 14 rigidly and sealingly affixed thereto. In conventional manner, end cap 14 includes an integral yoke 16 comprising a pair of parallel arms having openings therethrough for affixment to a rigid member of the structure within which the cylinder is to be employed. End cap 14 further includes a fluid flow port 18 through which the hydraulic fluid enters and leaves the left hand chamber (descriptive terminology only) during the movement of the piston. Fluid flow port 18 further is shown to include a horizontal portion 20 which is substantially co-axial with the cylindrical body portion 12. As will be understood shortly, the horizontal portion 20 of the port 18 is of sufficient depth to accommodate cushion pin 44 when the piston is in its fully retracted (left in the drawing) position. A second fluid flow port 22 extends through the wall of body 12 and, in conventional manner, along with fluid flow port 18 and other hydraulic components (not shown) provide the means by which the piston retracts and extends during operation.

A piston 24 is located within the hollow body portion 12 for axial movement therein according to the variations in pressure in the left hand and right hand chambers of the cylinder. A fluid seal 26 is located around the periphery of the piston 24 to ensure that undesirable fluid and pressure losses do not occur. A ram, or piston rod, 28 is affixed to the piston and extends away therefrom past the second end of the body portion 12. Again, in conventional manner, a yoke 30 is affixed to the terminal end of the piston rod 28 for affixment to a movable component of the apparatus in which the cylinder is employed. The second end of the body portion 12 is sealed by a sealing member 32 which is rigidly affixed in position and ensures that fluids to not pass out the second end, either along the walls of body portion 12 or along the piston rod 28.

Figure 2:
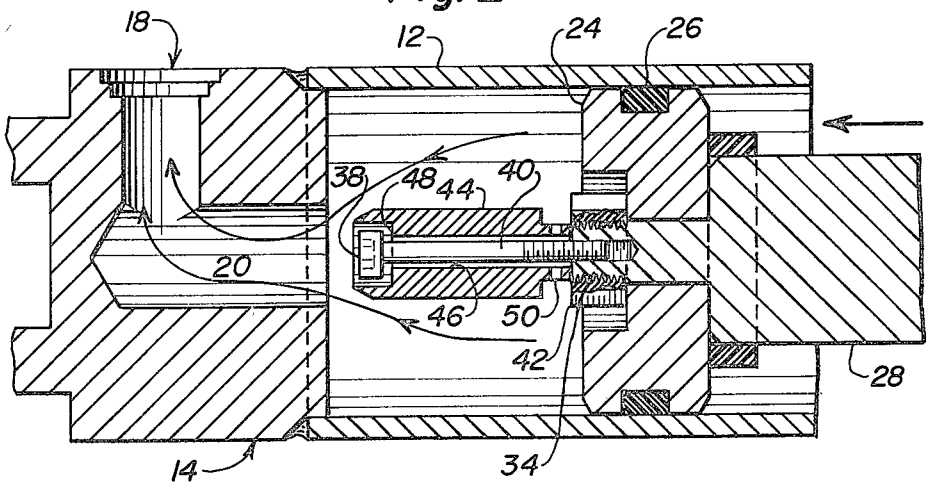
FIG. 2 is an enlarged view of a segment of FIG. 1 showing the cushion pin of the instant invention in cross section as the piston approaches the fluid port.

As can perhaps best be seen in FIG. 2, the cushion device of the instant invention is shown to comprise a cap screw 36 and a cushion pin 44. Cap screw 36 includes an enlarged head 38 and a rod-like body portion 40 which is threadably engaged into the end portion of rod 28 which extends through piston 24. The cushion pin 44 is an elongate member having an axial opening 46 therethrough which is of diameter slightly larger than that of portion 40 of cap screw 36. This variation in diameters permits the cushion pin 44 to either rotate about cap screw 36 or to move laterally relative thereto. Additionally, it can be seen that cushion pin 44 is formed with an end step 48 within which the head 38 of cap screw 46 is located. The distance between the stop 48 and the opposing end of the cushion pin is less than the effective length of cap screw 36 (that distance from the bottom of head 38 to the top of holding nut 42). These length differentials permit the cushion pin 44 to move axially a short distance along cap screw 36. For purposes of description, it should be understood that the words "flotation" or "float" are used to describe the movements of the cushion pin about the cap screw relative to the piston.

The cushion pin 44 may advantageously include one or more orifices 50 through the sidewalls thereof adjacent the end thereof closest to the piston, to permit fluid to flow into the channel between axial opening 46 and portion 40 of cap screw 36. These orifices increase the flow of fluid to the left hand chamber during the extension phase of the cylinder cycle, accelerating the movement. During retraction, when cushion pin 44 enters portion 20 of fluid port 18, a higher pressure will be realized in the left hand chamber of the cylinder than the pressure in area 21 of portion 20, due to the effect of the orifice action of pin 44. This pressure differential will push cushion pin 44 against the head 38 of cap screw 36, preventing any fluid from flowing through the orifice(s) 50. Thus, there is provided means for differing the metering rates during the contraction and extension phases.

Figure 3:
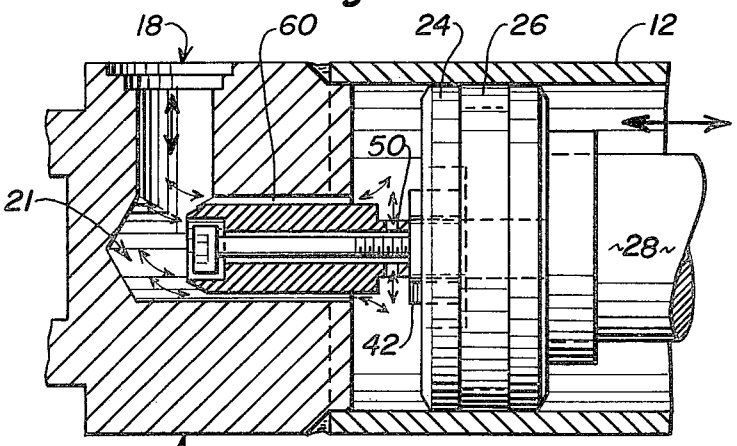
FIG. 3 is a cross sectional view, similar to FIG. 2, showing the cushion pin of the instant invention positioned within the fluid flow part.

In operation, as the piston moves toward the first end of the cylinder body portion 12, the fluid in the left hand chamber is forced through fluid flow port 18. As the piston approaches the fully retracted position, the cushion pin 44 begins to enter the horizontal portion 20 of end cap 14. In so doing, the effective orifice area of portion 20 is considerably reduced. This reduction in area causes a commensurate reduction in fluid flow and acts to effectively cushion the piston at this portion of its cycle. Because of the floating characteristics of the cushion pin 44, it enters and stays within the horizontal portion 20 in a concentric attitude relative thereto. When the piston is beginning its extension cycle (see FIG. 3) fluid is forced into fluid flow port 18 and reaches the first piston face through that orifice area between the portion 20 and the cushion pin 44. Additionally, the fluid flows around head 38 and body portion 40 of the cap screw 36 and through orifice or orifices 50. It should be readily understood by one of skill in the art, that the orifices 50 are not necessary, but do add to the acceleration of the piston during this extension phase of the cycle.

It will be understood that various other changes of the details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention.

Having thus described the invention, what is claimed is:

1. In a hydraulic cylinder having a generally elongate cylindrical hollow body with a first end and an opposing second end, a cylindrical piston with first and second opposing faces sealingly and slidingly positioned within the body, an elongate rod affixed to the second face of the piston and extending away therefrom past the second end of the body, a sealing member affixed to the second end of the body slidably and sealingly contacting the rod, an end cap sealingly affixed to the first end of the body, a first fluid port of at least partially cylindrical cross-sectional configuration having an effective diameter and extending through the end cap and having a portion thereof substantially parallel to the length dimension of the body, and a second fluid port into the body located between the piston and the sealing member, and means to cushion the piston movement, the improvement wherein the means to cushion comprises:

a cushion pin having an axial opening therethrough of a first diameter and a length dimension parallel to said axial opening, said cushion pin including at least one orifice therein adjacent said first face of said piston extending into said axial opening to allow fluid to flow through said axial opening and said orifice, said cushion pin further having an outside diameter substantially smaller than said effective diameter of said portion of said first fluid flow port parallel to the length dimension of said body to provide a first path between a wall of said parallel portion and said outside diameter of said cushion pin for the flow of fluid between said flow port and said body and to provide room for a centering movement of said cushion pin within said portion parallel to the line of movement of said piston; and an elongate cap screw including a head portion and a shaft portion having a second diameter smaller than said first diameter, said cap screw extending through said axial opening in said cushion pin with a length substantially parallel to the line of motion of said piston and greater than the length of said cushion pin and loosely fixing same to said first face of said piston for flotation relative thereto in directions both substantially parallel to and substantially perpendicular to said length dimension of said body, said cylindrical portion of sid first fluid port, said cap screw and said cushion pin positioned relative to each other such that as said piston approaches said end cap said cushion pin extends concentrically into and partially closes said first fluid port, the flow of fluid between said fluid flow port and said body being along said first path and a second path during the extension of said cushion pin from said fluid flow port and only along said first path during the retraction of said cushion pin into said fluid flow port, said second path being between said cushion pin and said cap screw, the movement of said cushion pin parallel to the line of movement of said piston permitting said cushion pin to engage said head portion of said cap screw to seal off the flow of fluid along said second path during said retraction of said cushion pin into said fluid flow port.

2. The hydraulic cylinder of claim 1 wherein the movement of said cushion pin away from the head of said cap screw permits the flow of fluid through said axial opening and said orifice, as well as between said cushion pin and said portion of said fluid flow port parallel to said line of movement of said piston, during the extraction of said cushion pin from said portion of said fluid flow port caused by extension of said piston.

3. The hydraulic cylinder of claim 2 wherein said cushion pin has an axial length substantially coextensive to the length of said portion of said fluid flow port parallel to said length dimension of said body.

* * * * *